US007291052B2

(12) United States Patent
Ellman et al.

(10) Patent No.: US 7,291,052 B2
(45) Date of Patent: Nov. 6, 2007

(54) TOY FIGURE PLAY APPARATUS

(76) Inventors: Steven Ellman, 1672 E. 7th St., Brooklyn, NY (US) 11230; Lawrence Mass, 5 Berkley La., Rye Brook, NY (US) 10573; Fredric Ellman, 30 Fairview Ave., Tarrytown, NY (US) 10591; Julius Ellman, 1672 E. 7th St., Brooklyn, NY (US) 11230

( * ) Notice: Subject to any disclaimer, the term of this patent is extended or adjusted under 35 U.S.C. 154(b) by 259 days.

(21) Appl. No.: 10/652,451

(22) Filed: Sep. 2, 2003

(65) Prior Publication Data

US 2005/0048866 A1 Mar. 3, 2005

(51) Int. Cl.
*A63H 3/16* (2006.01)
*A63F 1/00* (2006.01)

(52) U.S. Cl. ..... 446/100; 446/99

(58) Field of Classification Search ..... 446/4, 446/72, 137, 139, 268, 97, 99–100, 92, 330, 446/487, 376, 385; 273/236, 276, 288–291
See application file for complete search history.

(56) References Cited

U.S. PATENT DOCUMENTS

| | | | | | |
|---|---|---|---|---|---|
| 1,211,590 | A | * | 1/1917 | Kennedy | 446/99 |
| 1,322,713 | A | * | 11/1919 | Marshall | 446/100 |
| 2,359,907 | A | * | 10/1944 | Gilardi | 434/245 |
| 2,424,538 | A | * | 7/1947 | Beder | 446/69 |
| 3,009,267 | A | | 11/1961 | Bezark | |
| 3,375,604 | A | | 4/1968 | Alonso | |
| 3,464,146 | A | * | 9/1969 | McCurdy | 446/100 |
| 4,186,515 | A | | 2/1980 | Ogawa | |
| 4,595,378 | A | * | 6/1986 | Sweet et al. | 446/99 |
| 4,714,446 | A | * | 12/1987 | Lee | 446/311 |
| 4,723,931 | A | | 2/1988 | Allen et al. | |
| 5,378,184 | A | | 1/1995 | Bro et al. | |
| 5,480,341 | A | * | 1/1996 | Plakos | 446/373 |
| 5,766,077 | A | | 6/1998 | Hongo | |
| 5,788,554 | A | * | 8/1998 | Goodwin et al. | 446/100 |
| 6,106,360 | A | * | 8/2000 | Jenkins et al. | 446/369 |
| 6,132,282 | A | * | 10/2000 | Camp | 446/124 |
| 6,439,951 | B1 | | 8/2002 | Kawakita | |
| 7,081,033 | B1 | | 7/2006 | Mawle et al. | |
| 2002/0155782 | A1 | | 10/2002 | Kobayashi | |
| 2002/0155783 | A1 | | 10/2002 | Chan | |
| 2003/0020239 | A1 | * | 1/2003 | Hagen et al. | 273/296 |
| 2004/0212148 | A1 | | 10/2004 | Losey et al. | |

OTHER PUBLICATIONS

PCT International Search Report and the Written Opinion in International App. No. PCT/US04/24385 (13 pp.).

* cited by examiner

*Primary Examiner*—Eugene Kim
*Assistant Examiner*—Alyssa M Hylinski
(74) *Attorney, Agent, or Firm*—Dinesh Agarwal, P.C.

(57) ABSTRACT

A play apparatus in the form of a toy figure includes a body member that can be separated into left and right halves by dividing generally centrally along a generally vertical line or plane and can be joined with the opposing halves of another toy figure to create different figures. Each of the left and right halves preferably has a preassigned game or power value and a name. When the two halves are joined, they produce an original, solid-figure, or a split-figure, with a combined name and a combined game value. The two halves of an original, solid-figure, or the two halves of a split-figure, when joined, blend visibly seamlessly about a line of adjoinment. In addition, the facial, head, and torso features of the two halves also blend visibly seamlessly to create an overall external impression or visual image of a whole.

35 Claims, 15 Drawing Sheets

TOY FIGURE PLAY APPARATUS

BACKGROUND OF THE INVENTION

The present invention is generally directed to a play apparatus, and more particularly to a toy figure play apparatus that can be separated into left and right halves and joined with the halves of another toy figure to create different figures.

The prior art is replete with various toy/action figures and the like toys and includes those wherein various parts may be detached and reattached to configure various figures. Examples are disclosed in U.S. Pat. Nos. 1,322,713; 3,009,267; 3,375,604; 3,464,146; 4,186,515; 4,595,378; 4,723,931; 5,378,184; 5,480,341; 5,766,077; 5,788,554; 6,439,951 B1; and U.S. Patent Application Publication No. 2002/0155782 A1.

The conventional toy/action figures are generally configured to represent various animals and humanoid figures that children typically carry or play with. Generally, the toy/action figures are interacted with other toy/action figures by the children based on their overall appearances. In other words, a child with one toy/action figure interacts with another child with another toy/action figure. Since it is only the external appearance that a child has available to play with, the extent to which a game can be played by two children is limited. In summary, since the conventional toy/action figures only offer the children with the external appearance, the playing of various games is limited.

In addition, the conventional toy/action figures tend to replicate or create the overall impression of a single animal or humanoid figure that cannot be separated into halves. This further limits a child's imagination to combine two different figures to create a completely new figure for adding another dimension to a play.

In view of the drawbacks associated with conventional toy/action figures, there is a need in the industry for a toy figure play apparatus which offers a child with additional dimensions for a play.

OBJECTS AND BRIEF SUMMARY OF THE INVENTION

The principal object of the present invention is to provide a toy figure play apparatus which can be separated into two halves and joined with the halves of another toy figure play apparatus to create new or different figures.

An object of the present invention is to provide a toy figure play apparatus which can be separated into two halves each having a name. When the two halves are joined, the names of the two halves form a combined name for the joined, original figure (solid-figure). When one half from one toy figure is joined with a half from another toy figure, a new figure with a new name (split-figure) is created.

Yet another object of the present invention is to provide a toy figure play apparatus which can be separated into two halves each having a preassigned game (or power) value. When the two halves from the same toy figure are joined, their preassigned values create a combined value for the joined, original figure (solid-figure). When one half from one toy figure is joined with a half from another toy figure, a new figure (split-figure) is created. The combined game value of the new figure (split-figure) may be the same as the combined game value of one or both of the original, solid-figures (the halves of which are combined to create the new, split-figure), or may be different from one or both. The combined game value is preferably created by adding the game values of the two halves, but other method or step, such as multiplication, subtraction, division, etc., may also be used.

An additional object of the present invention is to provide a play apparatus which includes a toy figure having animal, humanoid, and/or other imaginary configurations. The toy figure can be separated into two halves about a generally central, vertical line or plane and joined to create the original figure (solid-figure). In addition, one half from one original figure. (solid-figure) having one configuration or external appearance, can be joined with a half from another original figure (solid-figure) having a different configuration or external appearance, to create a third new figure (split-figure) having a combined/joined configuration or external appearance of both the original figures. The original, as well as any new figure so created, have a visibly seamless blending of the two halves about the generally central, vertical line where they are joined. In addition, the facial, head, and torso features of the two halves also blend visibly seamlessly.

Yet an additional object of the present invention is to provide a play apparatus which includes a toy figure that adds another dimension to a child's imagination in a play by either having a preassigned game value or allowing the child to assign a game value. These game values may be altered to add yet another dimension to a play, and preferably include alpha/numeric or other characters or symbols.

In summary, the main object of the present invention is to provide a play apparatus which includes a toy figure that can be separated into two halves and combined to make the original figure, or to create a new figure by combining two halves from two different original figures.

At least one of the above objects is met, in part, by the present invention, which in one aspect includes a play apparatus comprising a body member separable into first and second sections by dividing about a line thereof. The first and second sections are joinable to form the body member comprising a generally visibly seamless blending of the first and second sections about the line.

Another aspect of the present invention includes a play apparatus comprising a first body member separable into first and second sections by dividing about a line thereof, and a second body member separable into third and fourth sections by dividing about a line thereof. One of the first and second sections is joinable with one of the third and fourth sections to form a third body member that includes a generally visibly seamless blending of one of the first and second sections and one of the third and fourth sections about an adjoining line thereof.

Another aspect of the present invention includes a play apparatus comprising a body member including first and second sections. The first and second sections are releasably joinable to form the body member. The first and second sections include first and second preassigned game values, respectively.

Another aspect of the present invention includes a play apparatus comprising a first body member including first and second releasably joinable sections, a second body member including third and fourth releasably joinable sections, the first, second, third and fourth sections including a first, second, third and fourth preassigned game values, respectively. The lengths of the first and second body sections are substantially the same. The first body member has a first external appearance, and the second body member has a second external appearance different from the first external appearance. One of the first and second sections can be joined with one of the third and fourth sections to form a third body member having a third external appearance.

Another aspect of the present invention includes a play apparatus comprising a toy figure including first and second sections including first and second game values, respectively, and a housing member for holding the toy figure. The housing member includes a sensor for reading one of the first and second game values.

Another aspect of the present invention includes a play apparatus comprising a first toy figure including a first game value, a housing member for holding the first toy figure, and a sensor for reading the first game value.

Another aspect of the present invention includes a play apparatus comprising a body member including first and second sections, a connection member for releasably joining the first and second sections to form the body member, an element for indicating a game value for the play apparatus, and a mechanism for varying the game value.

Another aspect of the present invention includes a play apparatus comprising a body member including first and second sections being releasably joinable to form the body member, and an element for assigning a game value to one of the first and second sections.

BRIEF DESCRIPTION OF THE DRAWINGS

The above and other objects, novel features and advantages of the present invention will become apparent from the following detailed description of the preferred embodiment (s) invention, as illustrated in the drawings, in which.

DETAILED DESCRIPTION OF THE PREFERRED EMBODIMENT(S) OF THE INVENTION

Figure 1:
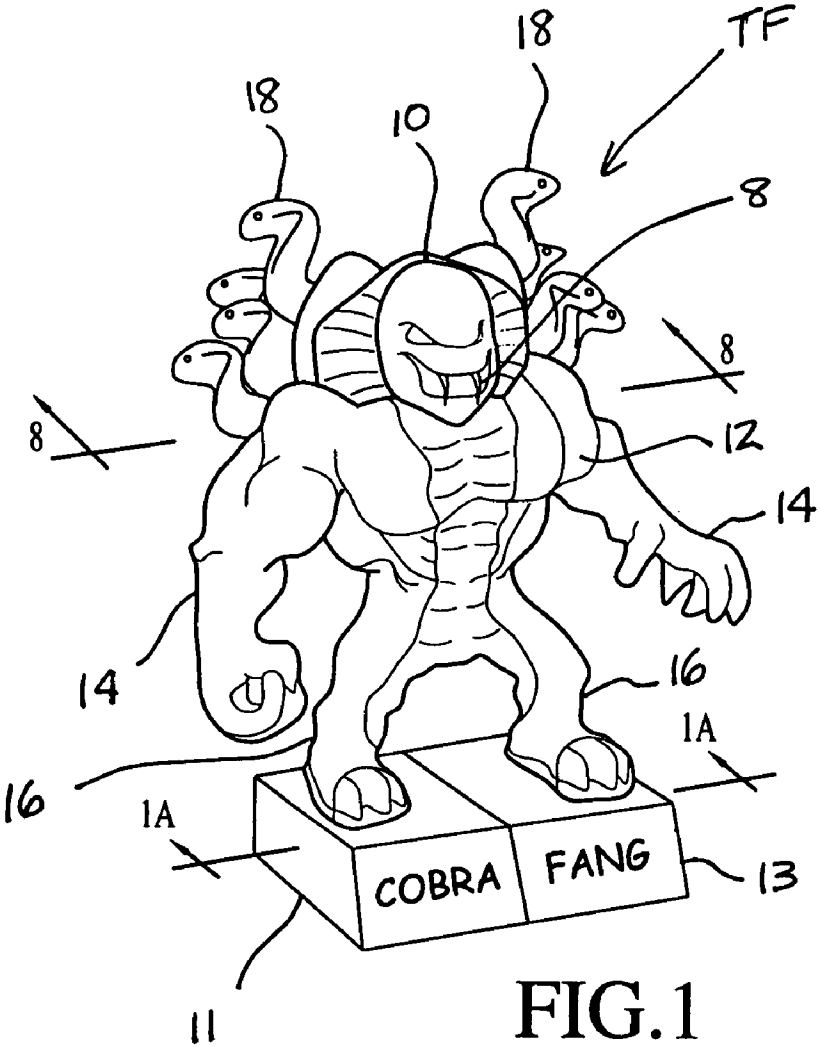
FIG. 1 is a perspective view of a toy figure play apparatus (solid-figure) in accordance with the present invention.
Figure 1A:
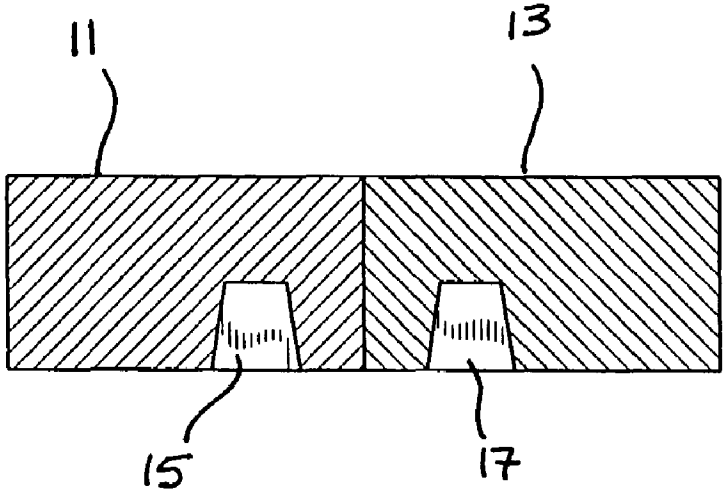
FIG. 1A is an enlarged sectional view taken along line 1A-1A of FIG. 1.

As best shown in FIG. 1, the play apparatus of the present invention is in the form of a toy figure TF having humanoid and animal (snake-like) characteristics. In particular, the toy figure TF includes a head 10, a torso 12, arms 14, and legs 16. Further, the toy figure TF includes snake-like appendages 18 extending from the back thereof, and fangs 8. The figure, TF stands on releasably joined bases 11 and 13 that include generally elongated, frustoconical slots 15 and 17, respectively (FIG. 1A), the function of which is described below.

Figure 2:
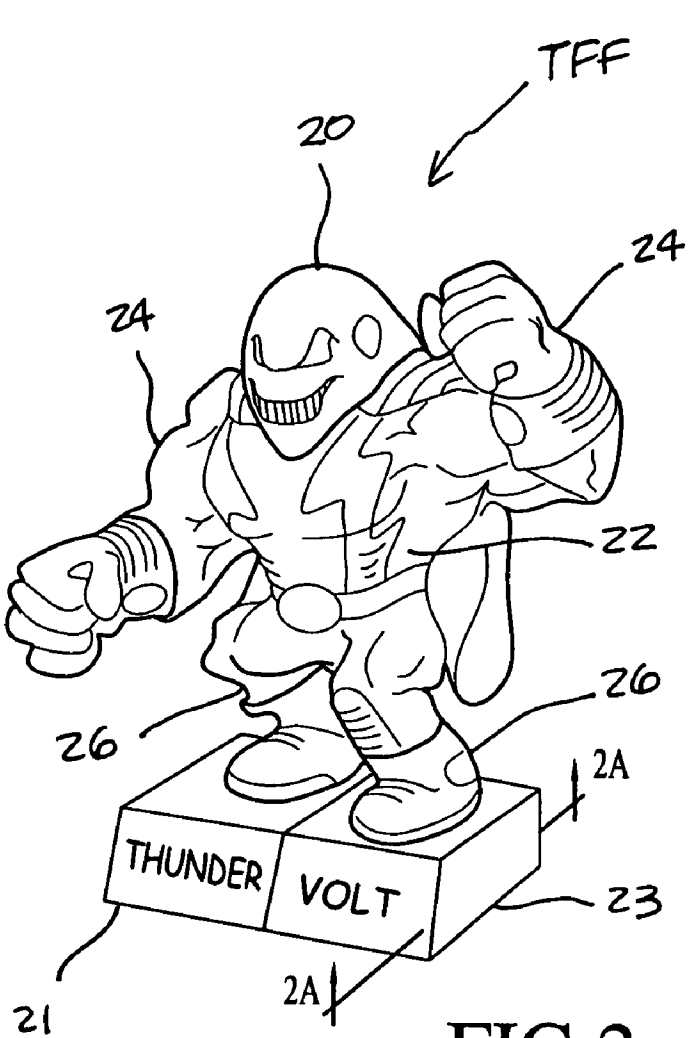
FIG. 2 is a perspective view of another toy figure play apparatus (solid-figure) in accordance with the present invention.
Figure 2A:
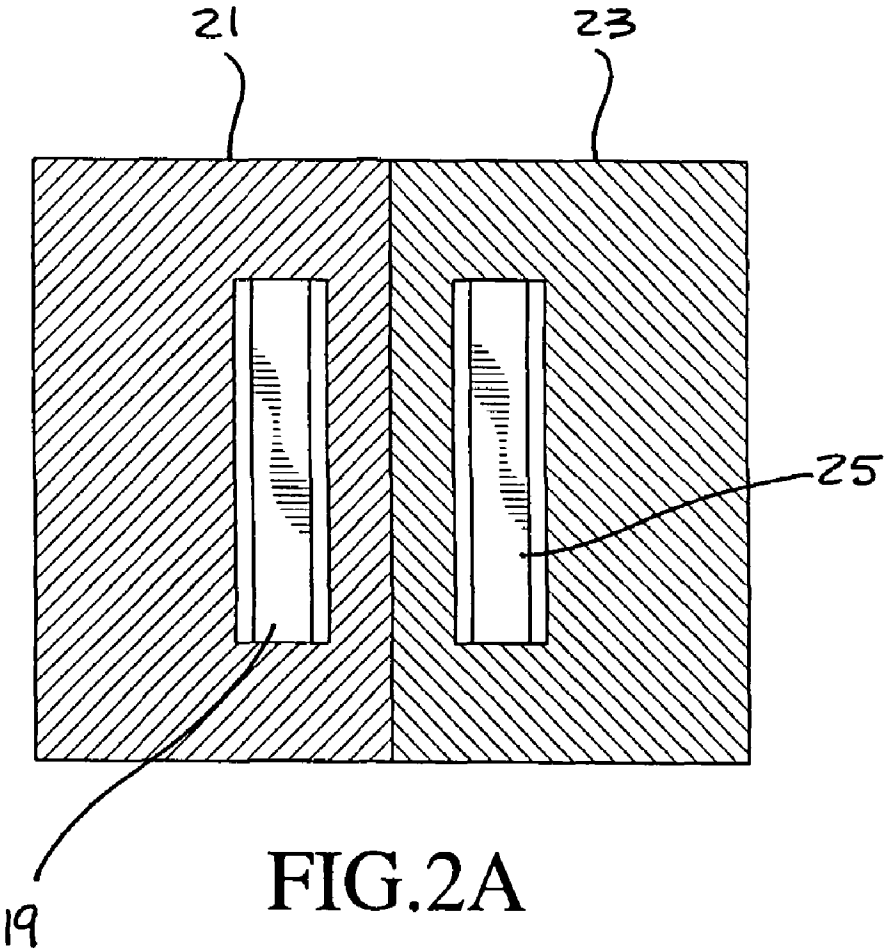
FIG. 2A is an enlarged sectional view taken along line 2A-2A of FIG. 2.

FIG. 2 illustrates another form of a toy figure TFF in accordance with the present invention, which imparts the external appearance of a well-known comic character Superman®. The toy figure TFF also has a head 20, a torso 22, arms 24, and legs 26, and stands on releasably joined bases 21 and 23. The bases 21 and 23 also include generally elongated, frustoconical slots 19 and 25, respectively (FIG. 2A), the function of which is described below.

Figure 3:
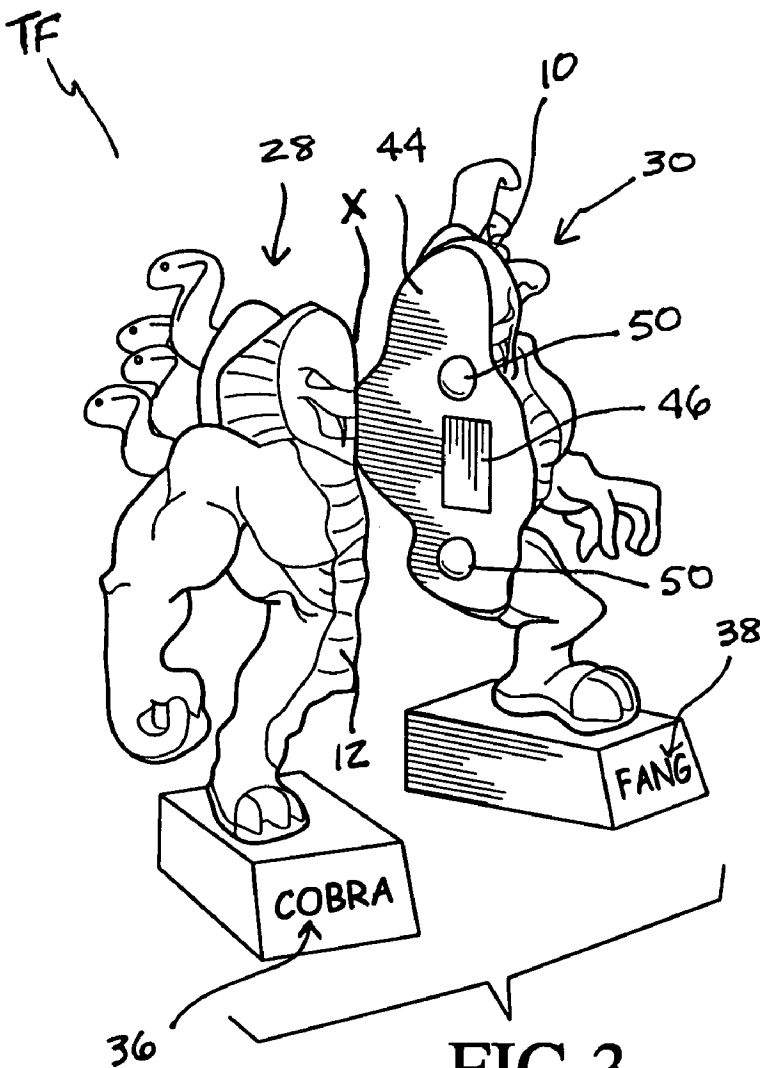
FIG. 3 is a view of the toy figure of FIG. 1, shown in a separated position.

As best shown in FIG. 3, the toy figure TF can be separated into left and right halves 28 and 30, respectively, by dividing preferably generally centrally along a generally vertical line or plane X from head 10 to the bottom of torso 12, and easily joined to form the complete original figure by a mechanism, described below in more detail. Likewise, the toy figure TFF can also be separated into left and right halves 32 and 34, respectively, by dividing preferably generally centrally along a generally vertical line or plane Y from head 20 to the bottom of torso 22, and joined by a similar mechanism, described below in more detail. It is noted that when the two halves are joined, they generally visibly seamlessly blend together about their line of adjoinment. In addition, their head, facial, and torso features also blend generally visibly seamlessly to create an overall external impression or visual image of a whole.

Figure 4:
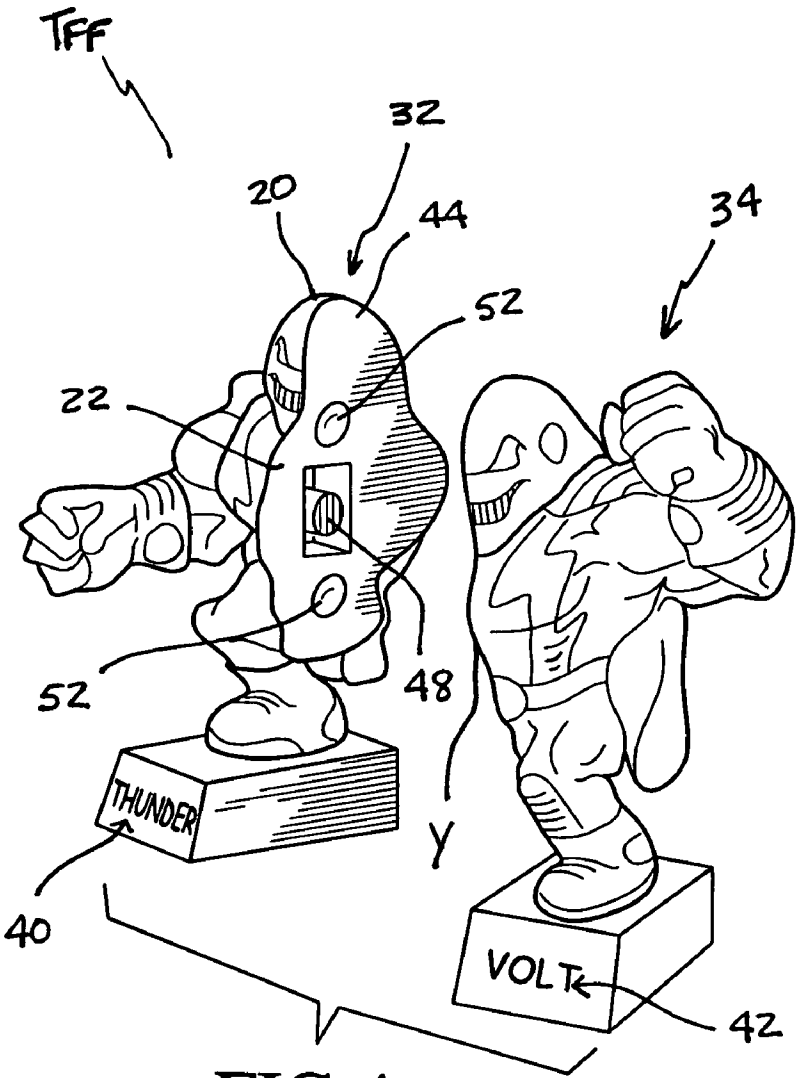
FIG. 4 is a view of the toy figure of FIG. 2, shown in a separated position.

As best shown in FIG. 3, the toy figure TF is given a name (COBRAFANG) that is preferably generally consistent with its external appearance, and includes a first portion 36 (COBRA) for the left half 28, and a second portion 38 (FANG) for the right half 30. Likewise, the toy figure TFF is also given a name (THUNDERVOLT) that is preferably generally consistent with its external appearance, and includes a first portion 40 (THUNDER) for the left half 32, and a second portion 42 (VOLT) for the right half 34 (FIG. 4).

It is noted herewith that the external appearances and the characteristics of the toy figures TF and TFF and their assigned names, as noted herein, are merely for the purpose of illustration and do not limit the scope of the invention. Various other forms, configurations, characteristics, names, other features, etc., may be used to create various other embodiments of the toy figures in accordance with the present invention. For instance, toy figures having humanoid, animal-like, or other imaginary characteristics and features, alone or in combination thereof, may be created in accordance with the present invention.

As noted above, toy figures TF and TFF can be separated into their corresponding left and right halves (FIGS. 3 and 4) and joined to form their original figures (FIGS. 1 and 2). However, in another aspect of the invention, either of the left and right halves 28 and 30 of the toy figure TF, can be joined with the opposing right and left halves 34 and 32 of the toy figure TFF, thereby creating a new toy figure.

For the sake of clarity and ease of understanding, an original toy figure, such as toy figure TF or TFF (FIGS. 1 and 2) is hereinafter referred to as a "solid-figure", and a new figure created by joining two halves of two original figures, such as toy figures SF or SFF, is hereinafter referred to as a "split-figure".

Figure 6:
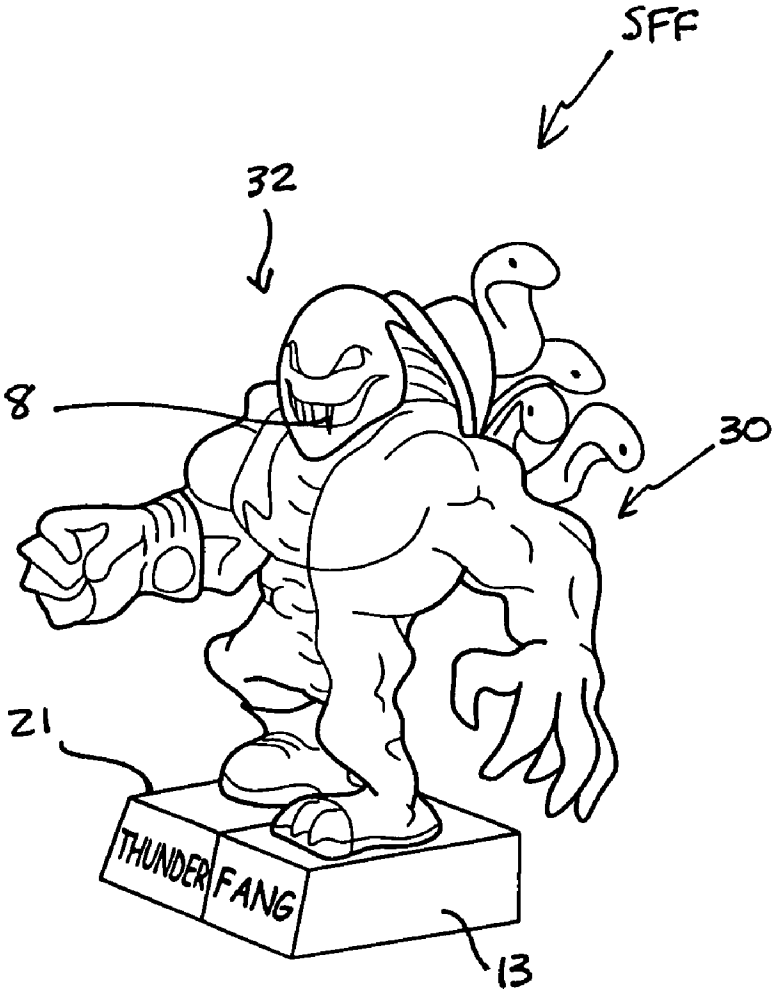
FIG. 6 is a perspective view of a split-figure created by joining the right half of the toy figure of FIG. 1 and the left half of the toy figure of FIG. 2.
Figure 5:
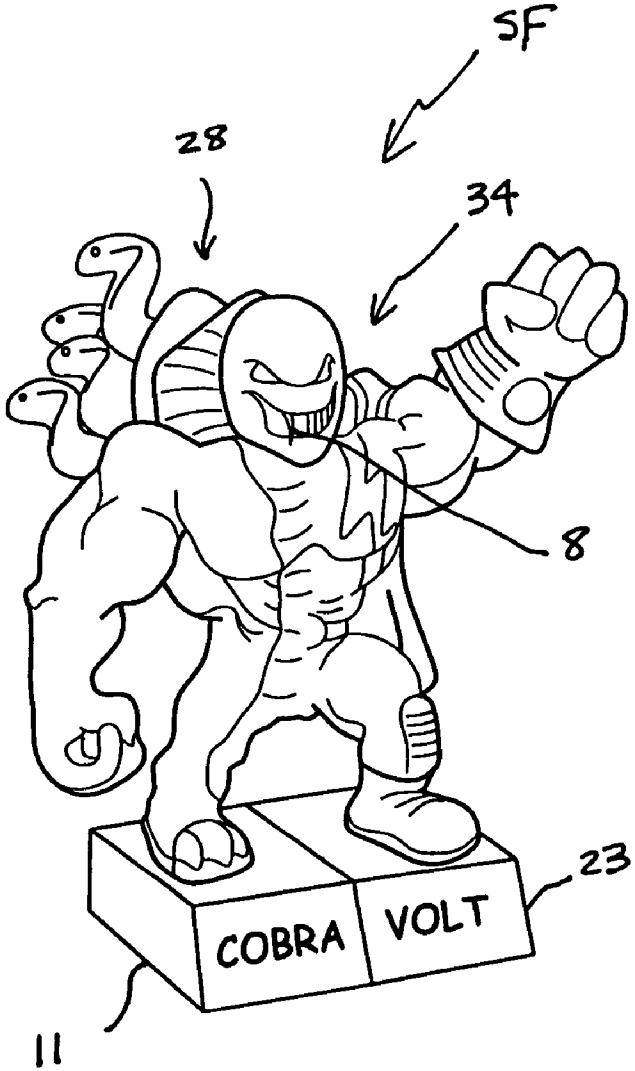
FIG. 5 is a perspective view of a split-figure created by joining the left half of the toy figure of FIG. 1 and the right half of the toy figure of FIG. 2.

As an illustration, the left half 28 of the toy figure TF can be joined with the opposing right half 34 of the toy figure TFF to create a new or split-figure SF, as shown in FIG. 5. Likewise, the left half 32 of the toy figure TFF can be joined with the opposing right half 30 of the toy figure TF to create a new or split-figure SFF, as shown in FIG. 6. In this regard, it is preferred that the mid cross-sectional side profile or area 44 of each half of the toy figures TF and TFF be identical or generally correspond to each other such that when any two opposing halves are joined, the newly created split-figure (SF or SFF) has a visibly seamless blending of head, face, torso, and other main body features (FIGS. 3-4, 6A and 6B) as in the case of original, solid-figures TF and TFF, noted above.

Figure 6A:
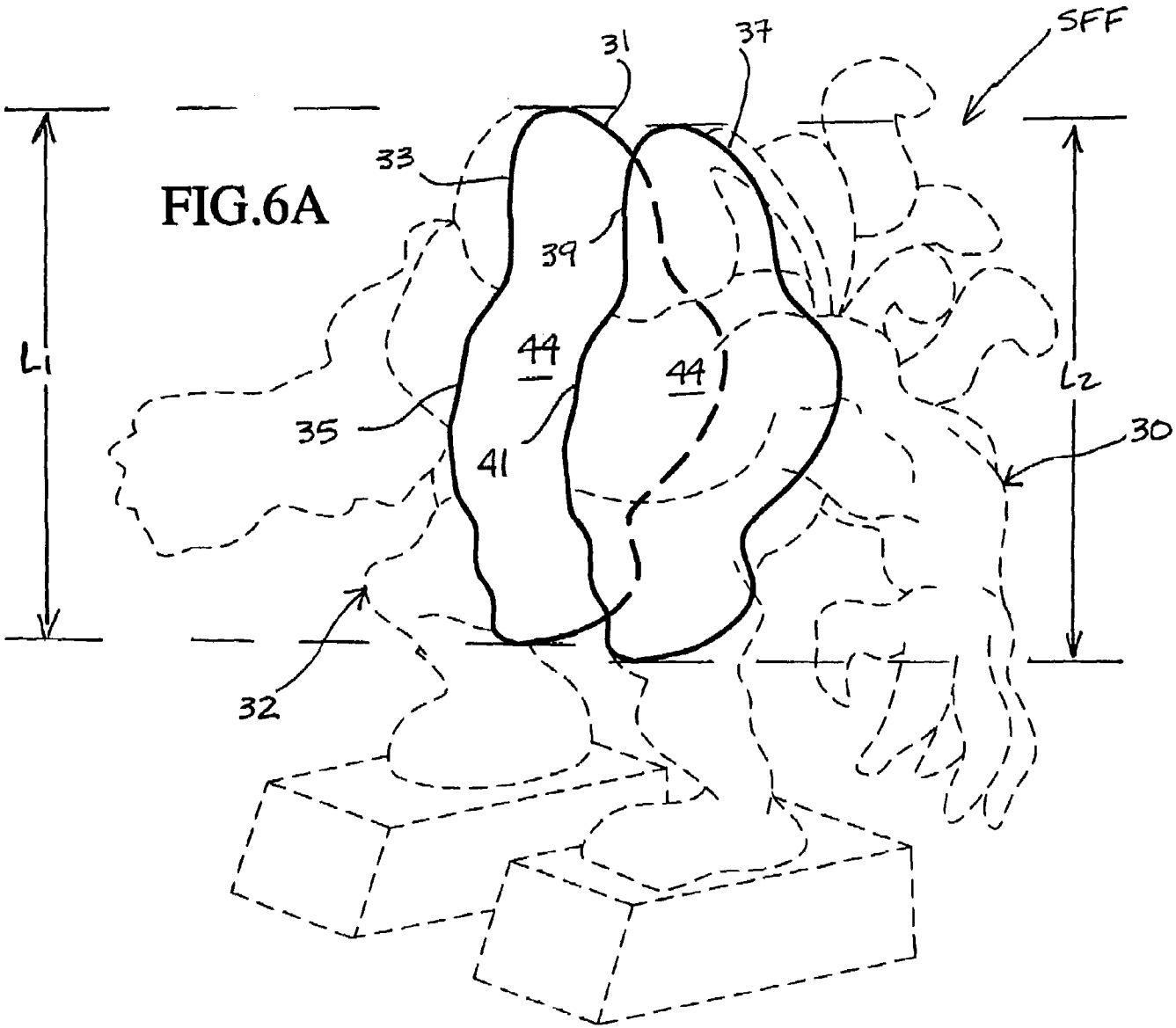
FIG. 6A is an enlarged view illustrating in solid lines the side profiles of two opposing halves of the split-figure of FIG. 6, showing in phantom lines the overall outline of the figure.

For example, as best shown in FIG. 6A, the profile 44 of the left half 32 of the toy figure TFF includes head, facial, and torso features 31, 33, and 35 that are preferably identical to or generally the same as head, facial, and torso features 37, 39, and 41 of the profile 44 of the right half 30 of the toy figure TF. As a result, the head features 31 and 37, the facial features 33 and 39, and the torso features 35 and 41, of the corresponding halves 32 and 30, blend visibly seamlessly. In order to further enhance the blending, the lengths $L_1$ and $L_2$ of the two halves from the head to the bottom of the torso are kept to be identical or generally the same.

Figure 6B:
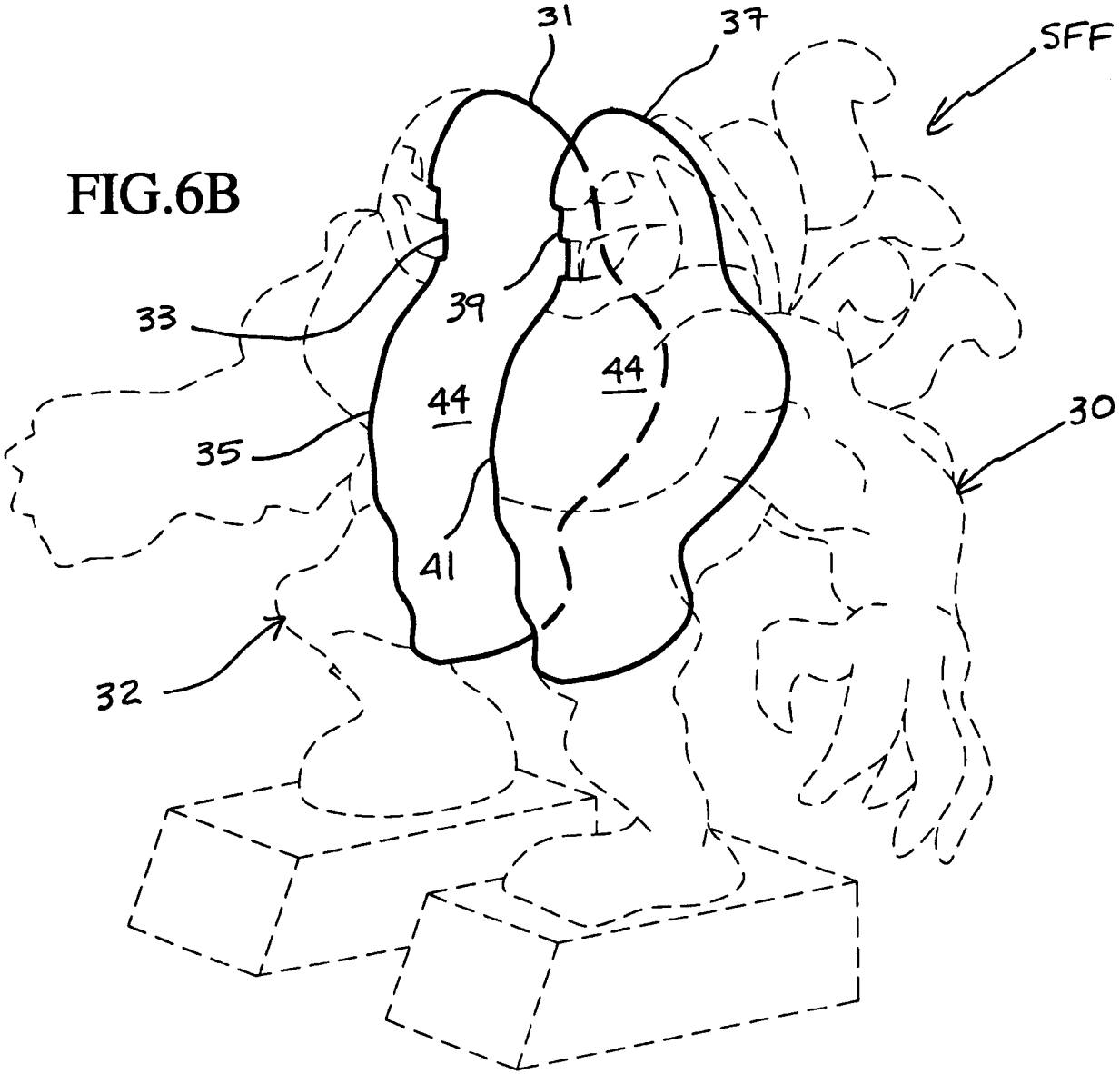
FIG. 6B is a view similar to FIG. 6A, showing an alternative embodiment of two opposing side profiles.

FIG. 6B illustrates another embodiment of the side profile for the toy figures TF and TFF, which is the same as the profile shown in FIG. 6A, except that the facial features are more distinctive to show, for example, forehead, nose, mouth, etc., of the toy figure.

Figure 6C:
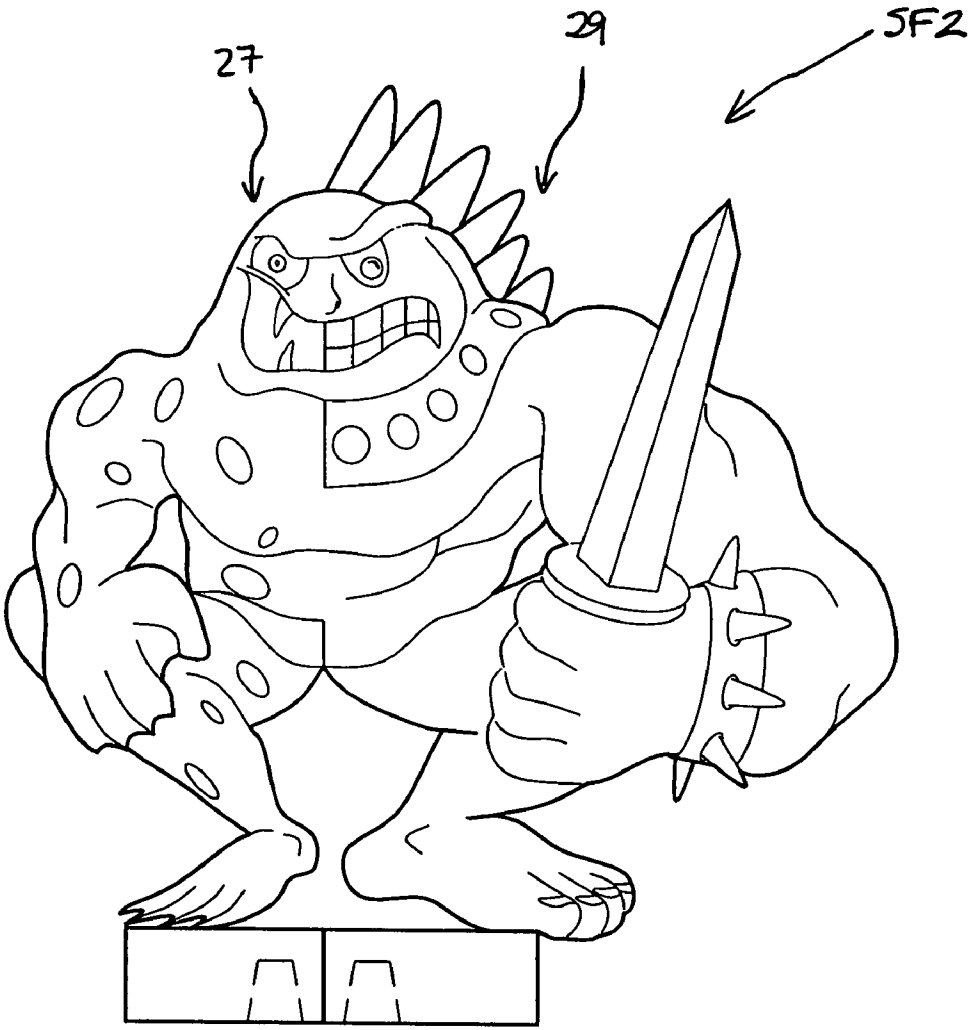
FIG. 6C is a front elevational view of a split-figure created by joining two unequal halves.

As illustrated in FIGS. 3 and 4, it is preferred that the left and right halves 28 and 30 of the toy figure TF generally correspond in overall size and/or shape to the opposing halves 34 and 32 of the toy figure TFF, so that when any two opposing halves are joined, a split-figure (for example, SF or SFF) having generally the same size and/or shape is created. However, it is within the scope of this invention to create a split-figure by joining two unequal halves. FIG. 6C illustrates a split-figure SF2 of this type. As shown, the split-figure SF2 is created by joining two unequal halves 27 and 29 about a mid-adjoining line thereof. It is preferred, however, that the length of each half from the top of the head to the bottom of the torso be identical or generally the same.

In order to join the two halves of a solid-figure (FIGS. 1 and 2), or a split-figure (FIGS. 5 and 6), a preferably magnetic joining mechanism is provided, which is illustrated and described by referring to the toy figure TF of FIG. 1.

Figure 8:
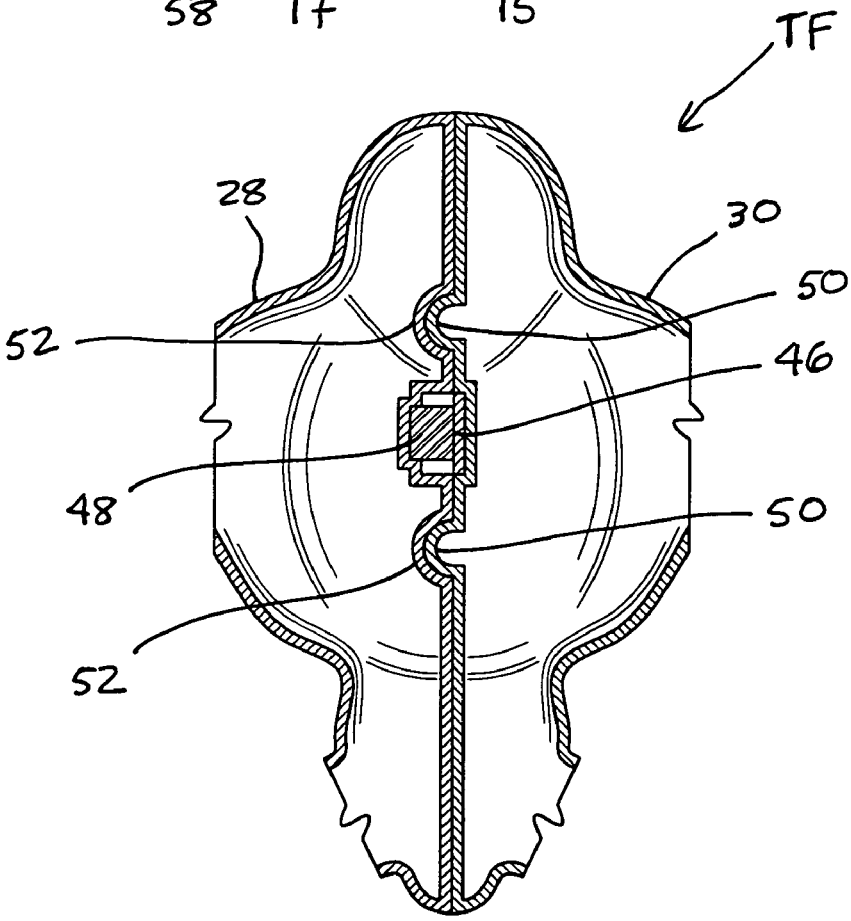
FIG. 8 is a partial enlarged sectional view taken along line 8-8 of FIG. 1.

As best shown in FIG. 8, a metal plate 46 is provided in the right half 30 of the toy figure TF, which snaps together with a magnetic or the like member 48 provided in left half 28 thereof. In order to assist in aligning the two halves, the right half 30 of the toy figure TF is provided with two vertically oriented generally convex projections 50 (FIG. 3) that are received in correspondingly aligned generally concave projections 52 in the opposing left half 28 (see, for example, FIG. 4). It is noted herewith it is within the scope of the invention to provide another suitable mechanism to align and join the two halves of any toy figure.

Figure 7:
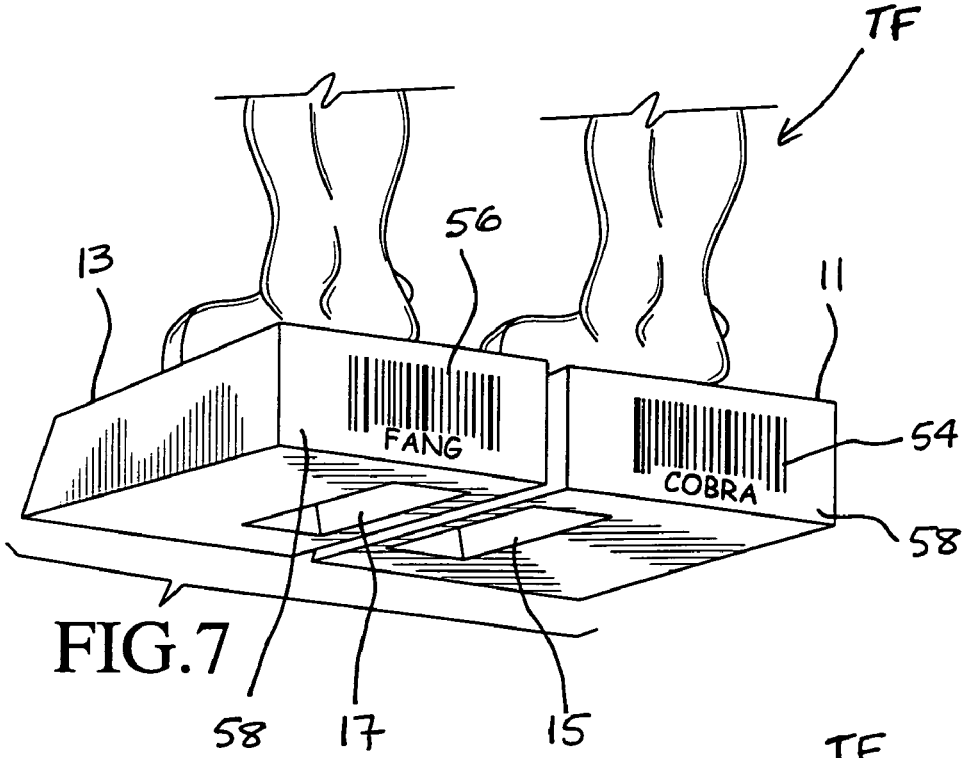
FIG. 7 is a partial enlarged rear perspective view of the toy figure of FIG. 1.
Figure 9:
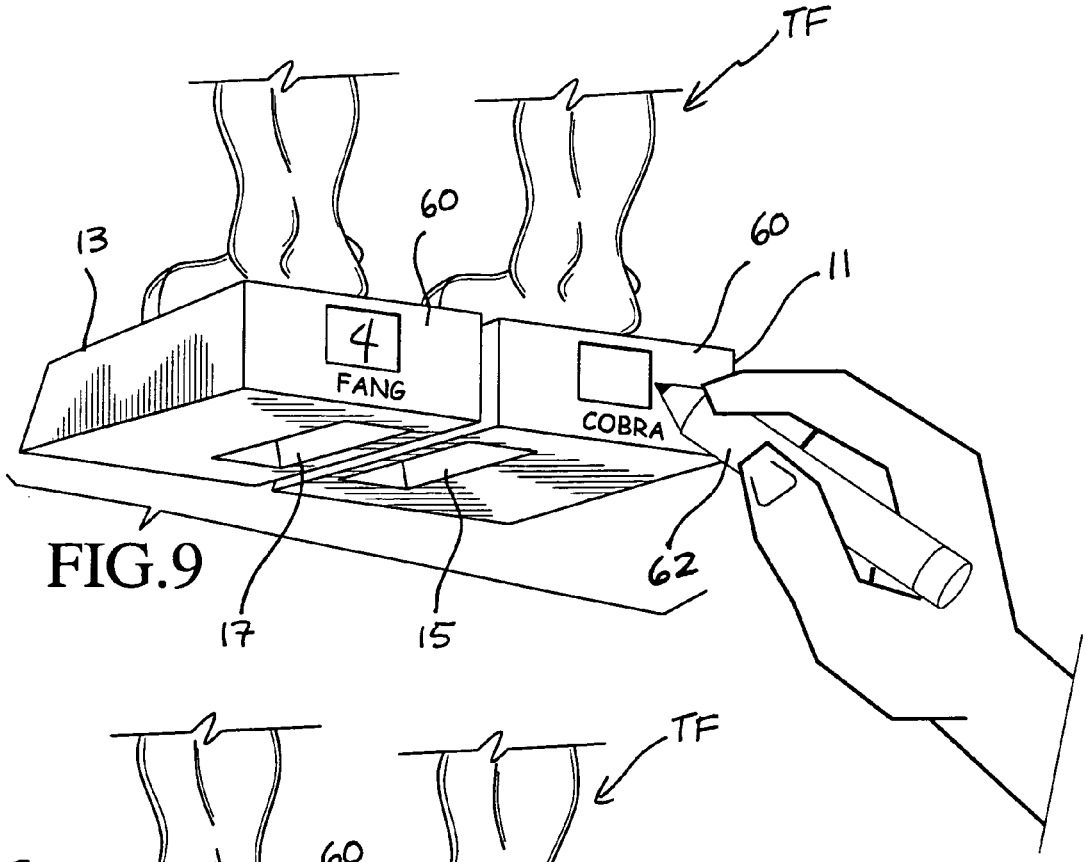
FIG. 9 is a view similar to FIG. 7, showing an alternative embodiment of a toy figure.

In addition to providing a name, each half of the toy figures TF and TFF may also be assigned a game or power value, preferably represented by alpha and/or numeric characters, which can be used by the children in a play. This value may be encoded in individual barcodes 54 and 56, affixed preferably on the back 58 of the corresponding bases 11 and 13, and 21 and 23 (FIG. 7—showing toy figure TF) to be read by a suitable scanner or sensor (described below) or written in a space 60 provided on the back of the bases 11 and 13, and 21 and 23, by a pen, pencil or the like instrument 62 (FIG. 9—showing toy figure TF). The name of the toy figures may also be encoded in the bar codes 54 and 56. (It is noted herewith that other suitable coding/scanning/sensor technology may also be used in place of the bar codes. For instance, a suitable chip, carrying the name and game value, may be embedded in the corresponding halves of the toy figures, which could be detected or read by a suitable sensor.)

Figure 10:
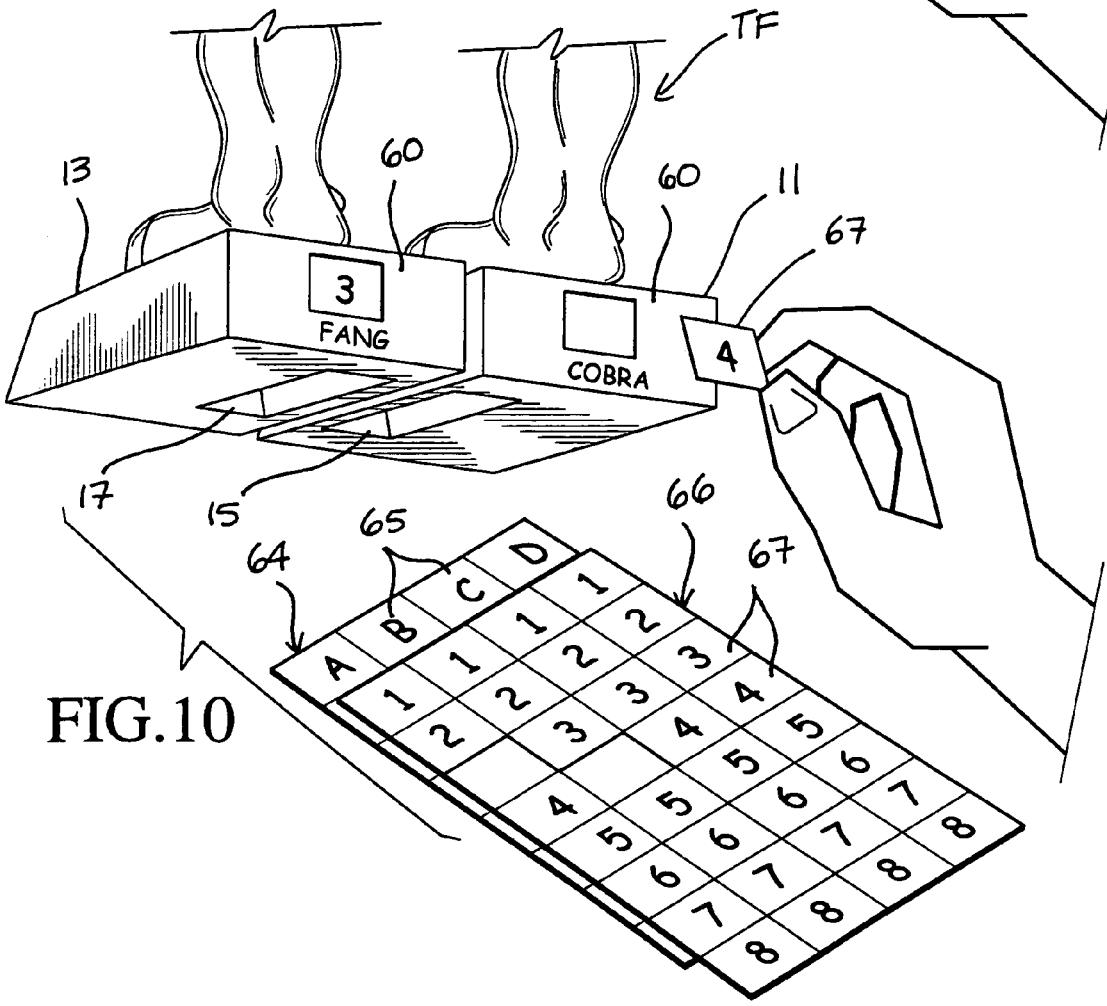
FIG. 10 is a view similar to FIG. 7, showing yet another embodiment of a toy figure.

Alternatively, sheets 64 and 66 of self-adhesive, peelable stickers bearing alphabet characters and numeric values 65 and 67, respectively, may be provided for pasting in the space 60 of the halves (FIG. 10). The game values of two halves produce a combined game value for a solid-figure or a split-figure, preferably by addition, but other method or step, such as subtraction, multiplication, division, etc., may also be used. In addition, or in place of, the alpha/numeric characters, the power value may be represented by using other symbols, characters, or shapes, such as circles, squares, triangles, swords, shields, lightening, sparks, etc.

It is noted herewith that in the embodiment of a toy figure with a bar code (FIG. 7), the power value of a half would be fixed and cannot be altered. However, in the embodiment shown in FIGS. 9-10, the power value can be easily changed by rewriting (FIG. 9), or pasting a new sticker (FIG. 10).

Although not shown, a suitable mechanism may be provided to audibly indicate the name and the game or power value of any toy figure when any of the two halves are combined.

Figure 11:
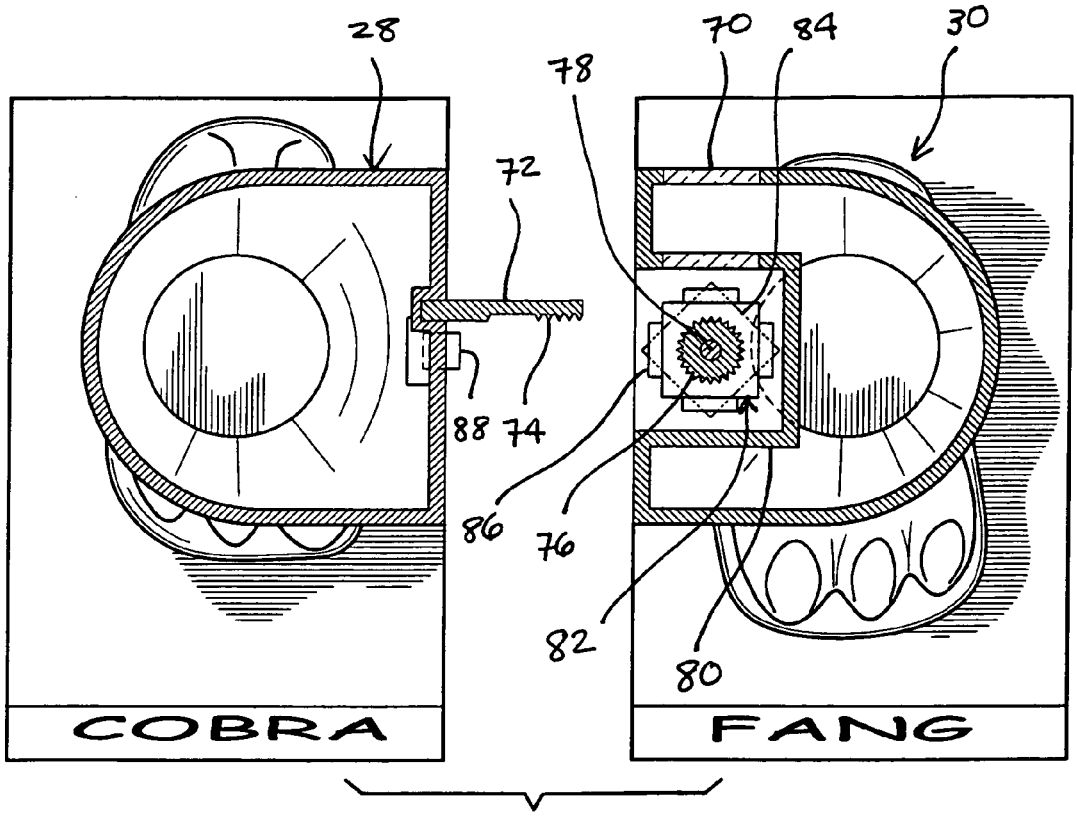
FIG. 11 is an enlarged horizontal sectional view of yet another embodiment of the toy figure of FIG. 1, shown in a separated position.
Figure 12:
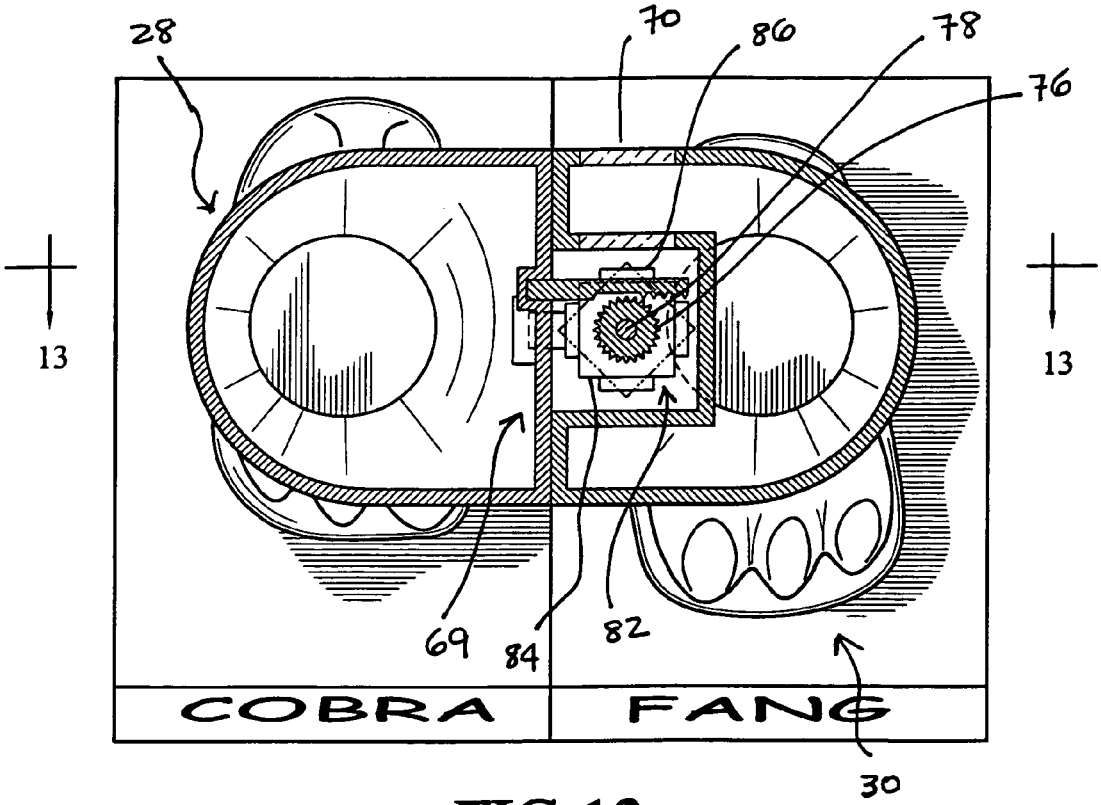
FIG. 12 is a view similar to FIG. 11, showing the toy figure in a joined position.
Figure 13:
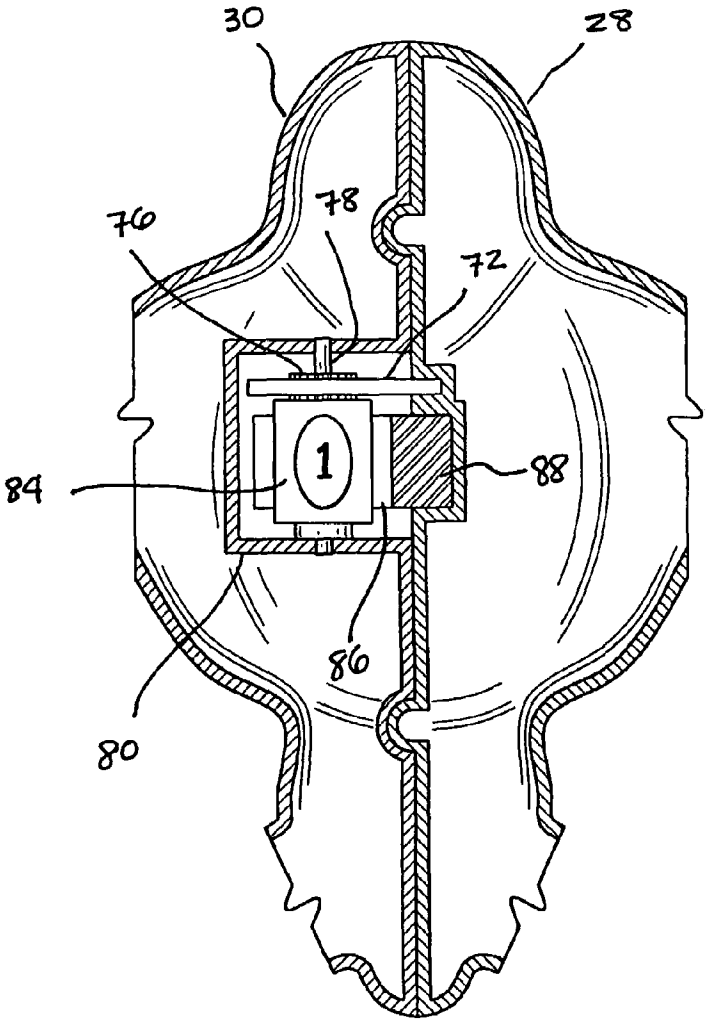
FIG. 13 is a partial enlarged sectional view taken along line 13-13 of FIG. 12.

FIGS. 11-13 illustrate, by referring to the toy figure TF, another embodiment of the play apparatus of the present invention wherein the game or power value varies automatically by a spinning mechanism 69, each time the two halves are rejoined to create a solid-figure or a split-figure, and can be seen through a window 70 provided on the back of the toy figure.

As best shown in FIG. 11, the spinning mechanism 69 includes a rack gear 72 extending from the back of the left half 28 of the toy figure TF, the teeth 74 of which intermesh with a pinion gear 76 located in the back of the right half 30. The pinion gear 76 is rigidly mounted on a pin 78 that is rotatably mounted in a casing 80 (FIG. 13). A spindle 82, with preferably four sides 84, is also rigidly mounted on the pin 78 and rotates therewith. Each side 84 of the spindle 82 is provided with a metal plate 86 that comes to engage a magnet or the like member 88 provided on the left half 28 of the toy figure TF. It is noted that different size metal plates 86 may be provided on the different sides 84 of the spindle 82, to provide varying holding strength indicating a game or power value for the toy figure. The game or power value is preferably provided on the metal plate itself to be externally visible through the window 70.

Figure 14:
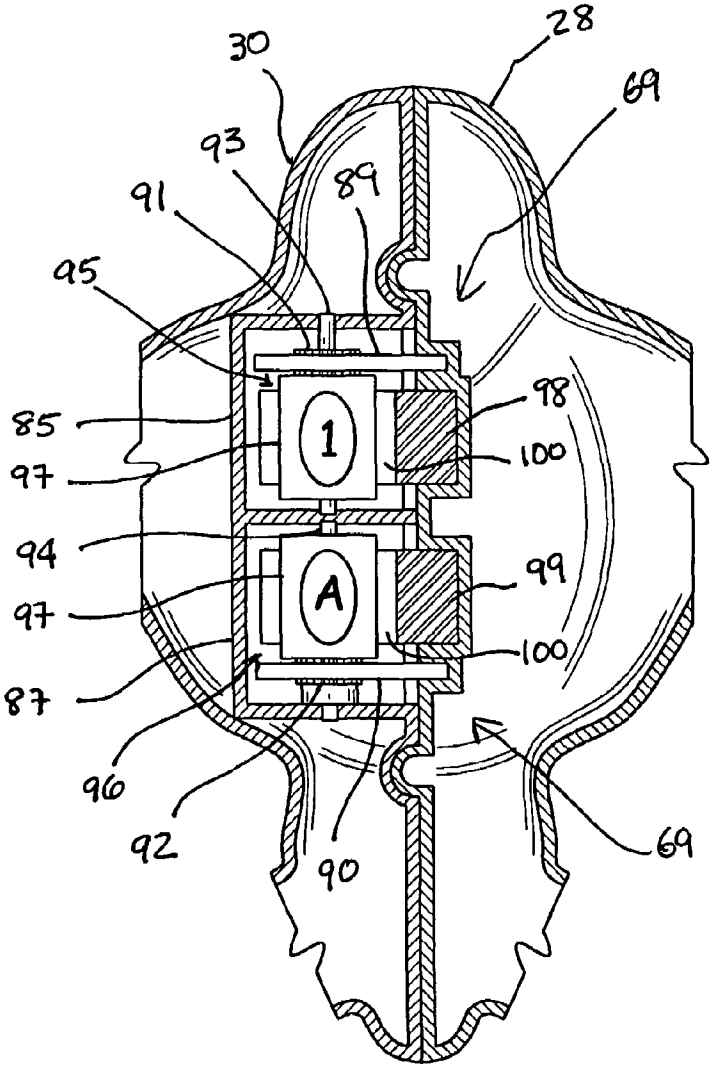
FIG. 14 is a view similar to FIG. 13, showing yet another embodiment.

FIG. 14 illustrates another embodiment, which is similar to the embodiment illustrated in FIGS. 11-13, with the exception that two spinning mechanisms 69 are provided one above the other in individual casings 85 and 87. As shown, top and bottom rack gears 89 and 90 extend from the left half and intermesh with corresponding pinion gears 91 and 92 in the right half. The pinions 91 and 92 are rigidly mounted on the corresponding pins 93 and 94 and are rotatable therewith.

Figure 15:
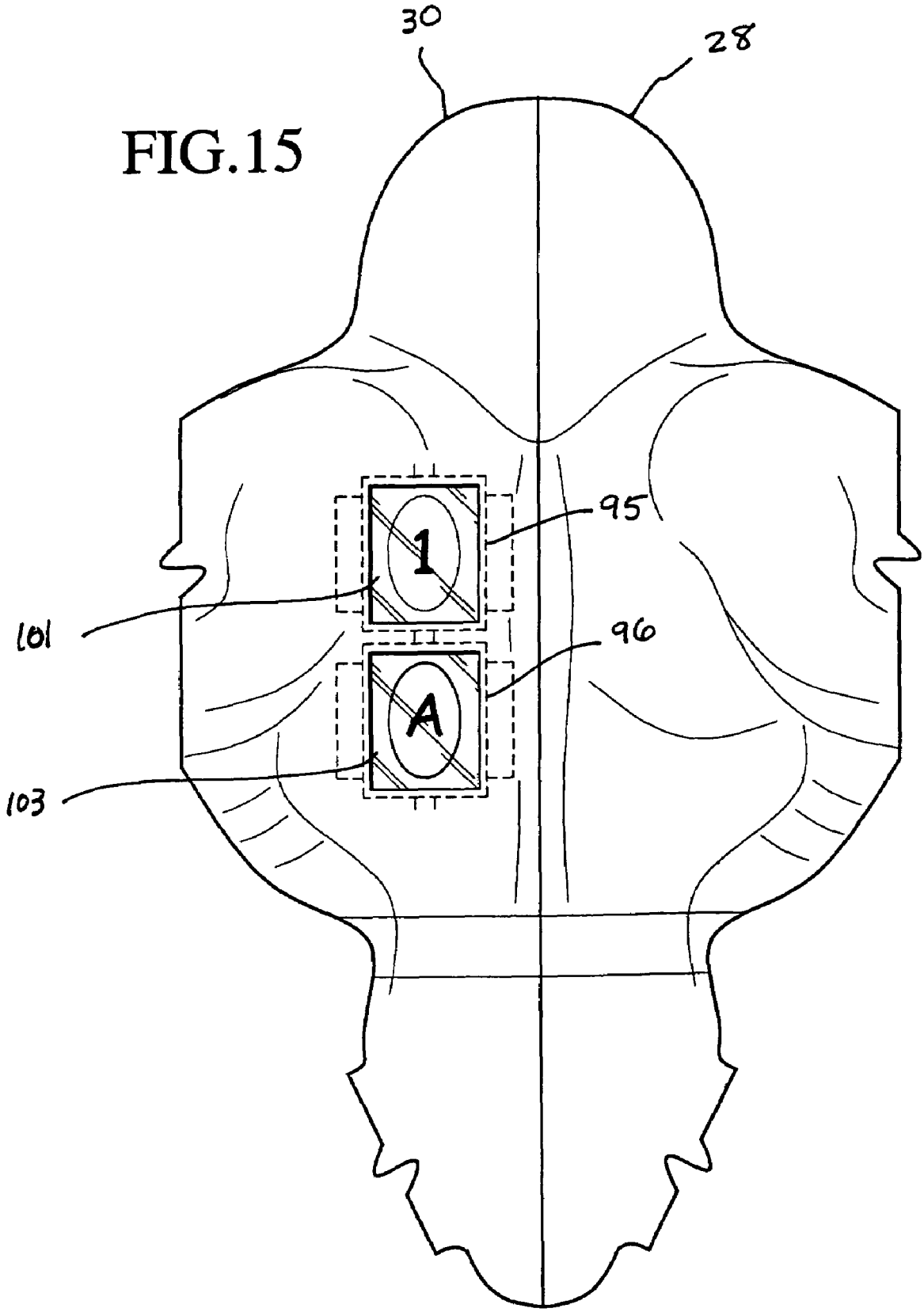
FIG. 15 is a rear elevational view of the toy figure shown in FIG. 14.

Two spindles 95 and 96, each with preferably four sides 97, are fixedly mounted on the corresponding pins 93 and 94, and are rotatable therewith. Two magnets 98 and 99 provided in the left half come to engage with a metal plate 100 provided on each side 97 of the spindles 95 and 96. The size of the plates 100 may be varied to provide a varying holding strength, as in the embodiment of FIGS. 11-13. It is noted herewith that since two individually rotatable spindles 95 and 96 are provided, numeric game or power value may be provided on the metal plates 100 of the spindle 95, and alpha power values may be provided on the plates 100 of the spindle 96, or vice-versa. The provision of alpha and numeric power values for the toy figures, adds more dimensions and freedoms of choice in playing a game. The values provided on the spindles 95 and 96 are externally visible through the windows 101 and 103 (FIG. 15).

Figure 17:
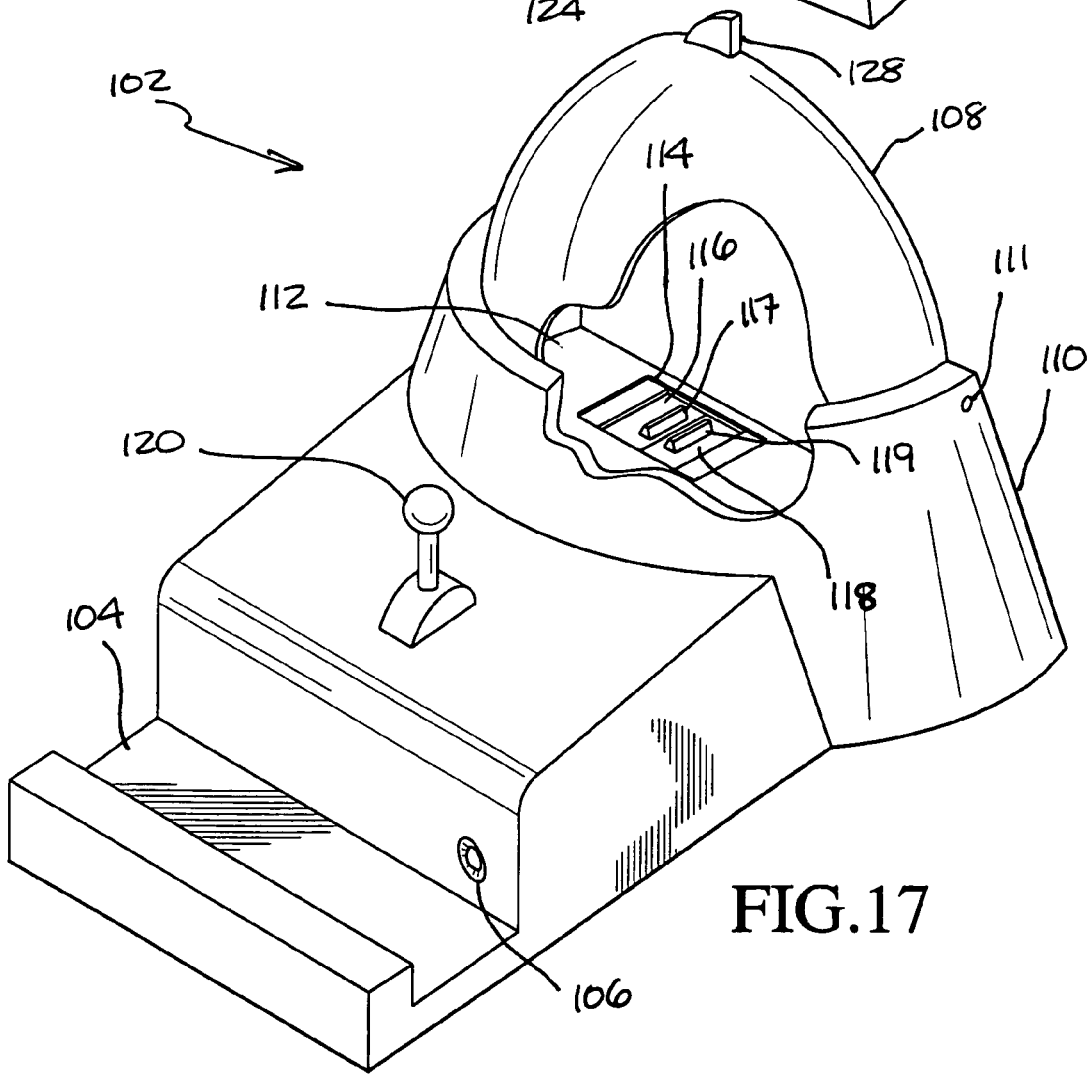
FIG. 17 is a left perspective view of a command center in accordance with the present invention.
Figure 19:
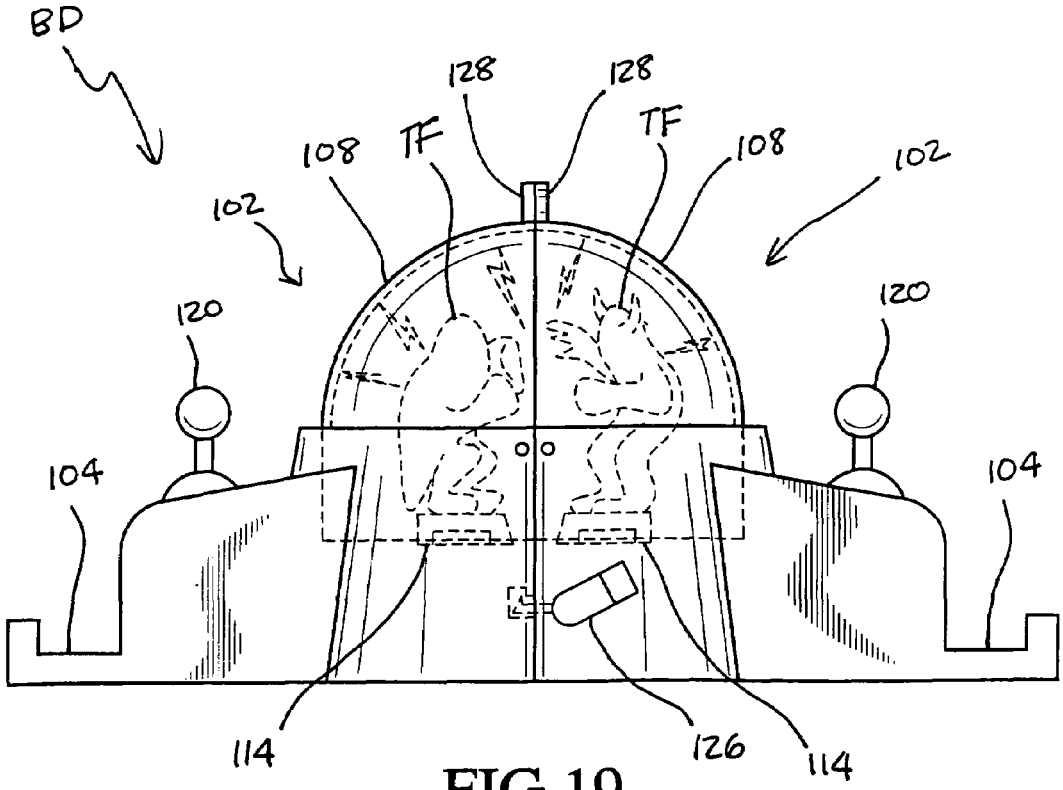
FIG. 19 is a front elevational view of the battle dome of FIG. 18, joined together and showing in phantom lines two toy figures in a battle position.

As best shown in FIG. 17, a command center 102 is provided for each toy figure. When two command centers 102 are joined face-to-face, they form a battle dome BD where an electronic game battle between two toy figures takes place (FIG. 19). Each command center 102 includes a scan bed 104 for sliding a toy figure therethrough. A scanner or sensor 106 reads the barcode (or detects the power value) and/or the name of the toy figure and stores in the command center for the battle.

The command center 102 further includes a half-dome 108 pivotally connected to a housing 110 by pins 111. A platform 112 includes a deck 114 where a toy figure stands during a battle. The deck 114 includes deck plates 116 and 118 with upwardly extending tabs 117 and 119, respectively, for securely holding a toy figure in place during a battle. For example, when the toy figure TF stands on the deck 114, the tabs 117 and 119 protrude into and are securely received in slots 15 and 17. In addition to securely holding a toy figure, the deck plates 116 and 118 can also be moved apart laterally by actuating handle 120 of the opposing command center 120 to cause the losing toy figure to separate. In this regard, handle 120 of one command center 102 would be internally mechanically and/or electronically linked to the deck plates 116 and 118 of the opposing command center.

Figure 18:
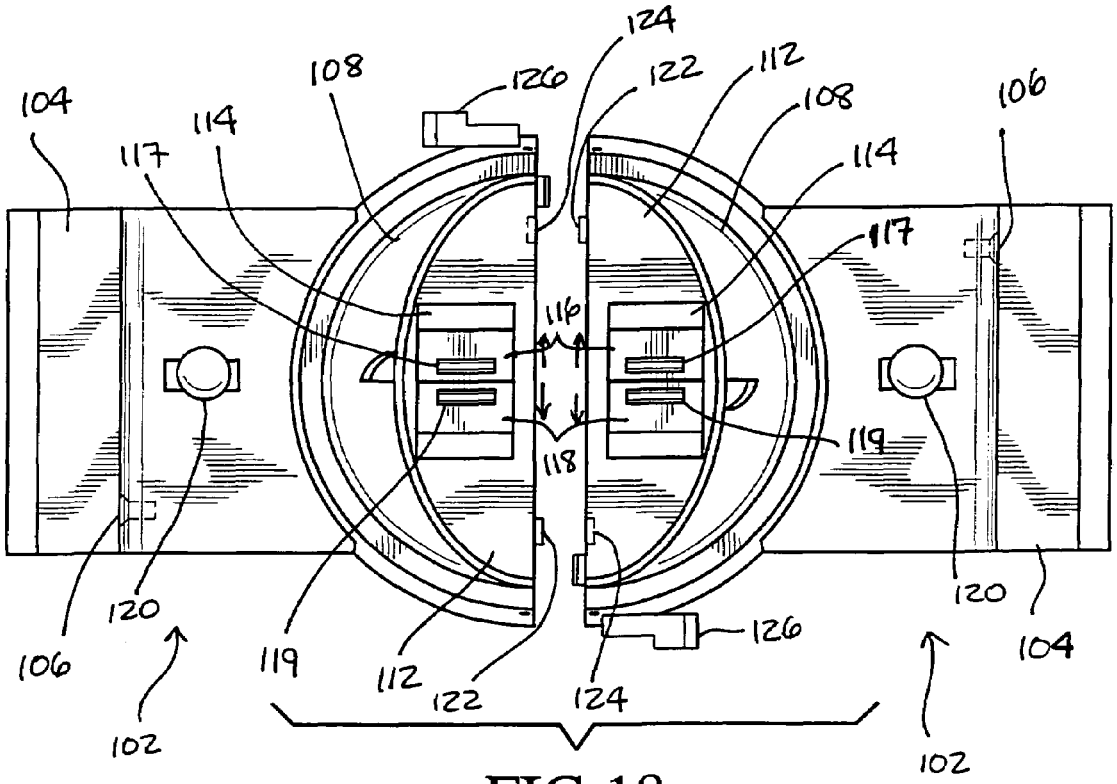
FIG. 18 is a top plan view of two command centers to be joined together face-to-face to form a battle dome for conducting a battle by the toy figures of the present invention.

As best shown in FIG. 18, projections 122 and recesses 124 assist in aligning the two command centers 102 face-to-face in preparation for a battle. The command centers 102 further include suitable locking mechanisms 126 to lock the two command centers in place. Each half-dome 108 is provided with a tab 128 that can be used to pivot the dome about the pins 111.

Figure 16:
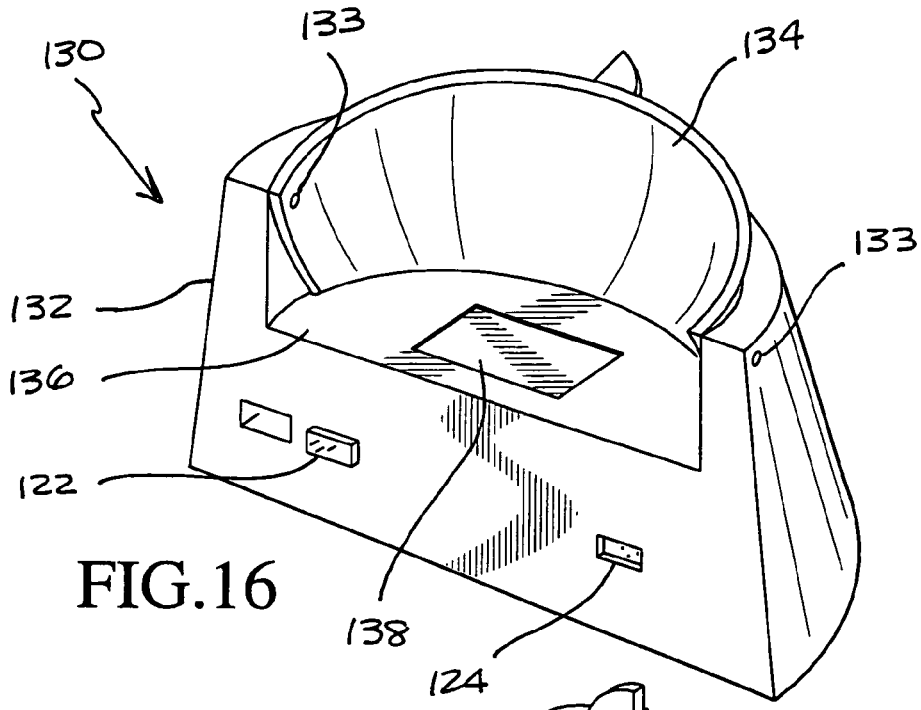
FIG. 16 is a perspective view of a training dome in accordance with the present invention.

FIG. 16 discloses a training dome 130 which is similar to the command center 102, with the exception that it does not include a scanning mechanism and the actuator handle for separating a toy figure. The training dome includes a housing 132 with a half-dome 134 pivotally connected thereto by pins 133. A platform 136 includes a deck 138 to stand a trainer or trainee toy figure thereon. The training dome 132 may be locked with a command center 102 face-to-face for training a toy figure in preparation for a battle or for improving skills.

Figure 20:
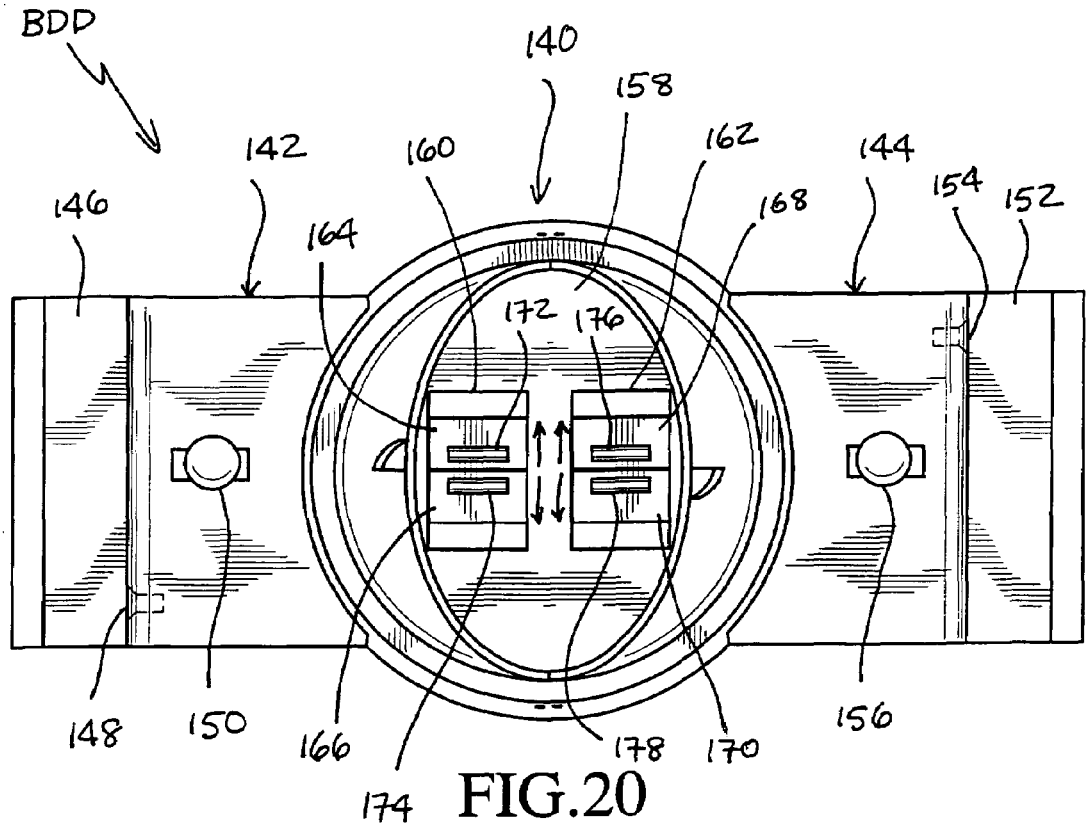
FIG. 20 is a top plan view of an alternative embodiment of a battle dome in accordance with the present invention.
Figure 21:
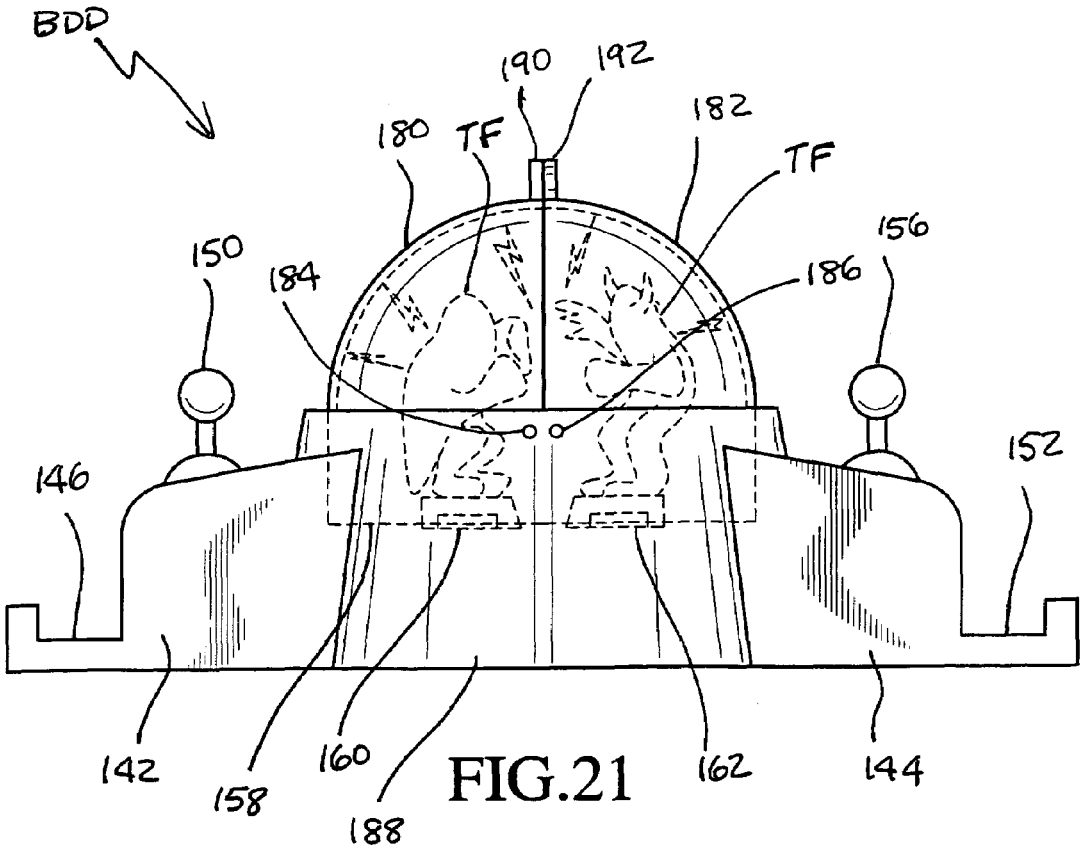
FIG. 21 is a front elevational view of the battle dome of FIG. 20.

FIGS. 20-21 illustrate another embodiment of the battle dome BDD, which is similar to the battle dome BD of FIGS. 18-19, except that it is formed as a single unit.

As shown in FIGS. 20-21, the battle dome BDD includes a central dome 140 and left and right command modules 142 and 144. The left command module 142 includes a scan bed 146 for sliding a toy figure therethrough, a scanner or sensor 148 for reading or detecting the game value and/or the name of the toy figure, and a left actuating handle 150 for splitting a toy figure. Likewise, the right command module 144 includes a scan bed 152, a scanner/sensor 154, and a right actuating handle 156.

The central dome 140 includes a platform 158 that supports left and right decks 160 and 162 for standing two toy figures for a battle. The decks 160 and 162 include laterally movable deck plates 164 and 166, and 168 and 170, with upwardly extending tabs 172 and 174, and 176 and 178. The tabs are received in the bottom slots of a toy figure (for example, slots 11 and 13 of toy figure TF).

The left and right handles 150 and 156 are internally mechanically and/or electronically connected to the opposite decks 162 and 160, respectively, to split a toy figure of the opposing player. For example, if the left handle 150 is actuated, the deck plates 168 and 170 would move laterally apart thereby splitting or separating the toy figure standing on the right deck 162. Likewise, by actuating the right handle 156, the toy figure standing on the left deck 160 would be separated into its corresponding halves. This arrangement allows a winning player to separate the toy figure of the losing player standing on the opposite side of the battle dome.

The central dome 140 includes left and right half-domes 180 and 182 pivotally supported at pins 184 and 186 on the housing 188. The domes 180 and 182 include tabs 190 and 192 for the ease of opening and closing thereof.

It is noted herewith each command center 102 (and command modules 142 and 144) would be preprogrammed with rules for various plays or battle games based on information about various toy figures and their characteristics, and various zones (or environments) for battle. For example, a split-figure would most often win a battle with a solid-figure, or a strongest/most powerful solid-figure would most often be weaker than a weakest split-figure, etc. Likewise, a toy figure having the characteristics of a sea creature would battle best in an ocean zone. Similarly a toy figure having the characteristics of a space creature would battle best in a space zone or environment. These rules would therefore determine the outcome of a battle between two toy figures.

As an alternative to or in addition to preprogramming the command center 102 (and command modules 142 and 144), the toy apparatus of the invention may include a portable memory card (or cartridge) carrying the desired information thereon. The memory card would be inserted into a suitable slot in the command center 102 or the command modules 142 and 144 for uploading the information. The information on the memory card could include, for example, various games to be played, history of the games played by a player, game values and characteristics of various toy figures, etc. The card could be carried by a child to by used when playing with another child's command center or battle dome. It is noted herewith that more than one card may be used, as appropriate.

USE AND OPERATION

It is noted herewith that while the toy figure play apparatus of the present invention may be used by children as plain toys like any other toy figure, the present toy figure adds a further dimension to the play in that each toy figure either has a preassigned game or power value, or a desired value can be assigned. These game values may then be used by children to devise their own games. For example, children playing with the toy figures of the present invention will attempt to guess the power or game value of an opponent's toy figure and determine the outcome of the game based on whoever has the toy figure with the higher value. Additional points or values may be assigned based on the characteristics of a particular type of toy figure. For instance, a toy figure that resembles a space creature may have higher (or lower) power value than a toy action figure that resembles a sea creature.

Another way to play the apparatus of the present invention is to simply create new split-figures by joining two halves of two different solid-figures. As noted above, each solid-figure has two individual names. Combining the halves of two different solid-figures would create a unique figure with a unique name. Also, since each half of a solid-figure has a unique game or power value, when two halves of two different solid-figures are joined, the newly created split-figure may have a game or power value that is the same or different from the power value of the original solid-figures.

Yet another way to play with the toy figure of the present invention is to use the command centers 102. For example, two children playing would lock their individual command centers 102 together to form a battle dome BD (FIG. 19). Each player would then scan his or her toy figure by sliding it across the scan bed 104 to allow the sensor 106 to read or detect the power or game value, as well as the name and characteristics of the corresponding figure. The figures would then be placed in their corresponding decks 114 and the domes 108 would be closed. Based on the power or game value and the characteristics of the two toy figures read into the command centers 102, and based on preprogrammed information already in the command center 102, including the type of battle zone or environment selected, the battle would begin and one of the toy figures would lose and be split into half by the opponent by actuating his/her handle 120. By creating a new split-figure by combining various halves of various solid-figures, the players can attempt to challenge and win over the opponent's toy figure. The battle dome BDD (FIGS. 20-21) may also be used in the like manner.

To make the game apparatus more interesting and fun to play, toy figures may be trained by a trainer toy figure. This would be done by combining a command center 102 with the training dome 130 in the same manner as setting up a battle dome BD (FIG. 18). Based on the preprogrammed information, a toy figure can be trained by a trainer to become stronger or better to fight in a battle or to improve skills.

It is noted herewith that while the present invention is described and illustrated in terms of a toy figure being separated into halves, it is within the scope of the invention to provide toy figures that are separated into non-halves, such as one-thirds and two-thirds, etc. Further, it is noted that while the game apparatus of the present invention has been described in terms of children, it can be fun and challenging to play by adults as well.

While this invention has been described as having preferred sequences, ranges, steps, materials, structures, features, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the appended claims.

What is claimed is:

1. A play apparatus, comprising:

a) a first body member comprising a front and a rear and being separable into first and second sections;

b) a second body member comprising a front and a rear and being separable into third and fourth sections;

c) each of said first and second body members including a head and a torso;

d) each of said first and second body members being separable about a corresponding generally central line extending from the top of the corresponding head to the bottom of the corresponding torso and from the front to the rear thereof;

e) one of said first and second sections being joinable with one of said third and fourth sections to form a third body member; and f) said third body member comprising a generally visibly seamless blending of said one of said first and second sections and said one of said third and fourth sections about an adjoining line thereof.

2. The play apparatus of claim 1, wherein:

a) said first, second, third, and fourth sections include first, second, third, and fourth profiles, respectively; and b) one of said first and second profiles is releasably joined with one of said third and fourth profiles to form said third body member.

3. The play apparatus of claim 2, wherein:

a) one of said first and second profiles comprises a side profile of the corresponding one of said first and second sections.

4. The play apparatus of claim 2, wherein:

a) said one of said first and second profiles and said one of said third and fourth profiles have generally the same configuration.

5. The play apparatus of claim 4, wherein:

a) said one of said first and second profiles comprises a side profile of the corresponding one of said first and second sections; and b) said one of said third and fourth profiles comprises a side profile of the corresponding one of said third and fourth sections.

6. The play apparatus of claim 1, wherein:

a) said one of said first and second sections and said one of said third and fourth sections include facial features; and b) said facial features blend generally visibly seamlessly when said one of said first and second sections and said one of said third and fourth sections are joined.

7. The play apparatus of claim 1, wherein:

a) said one of said first and second sections and said one of said third and four sections include head-like features; and b) said head-like features blend generally visibly seamlessly when said one of said first and second sections and said one of said third and fourth sections are joined.

8. The play apparatus of claim 1, wherein:

a) said one of said first and second sections and said one of said third and fourth sections include torso-like features; and b) said torso-like features blend generally visibly seamlessly when said one of said first and second sections and said one of said third and fourth sections are joined.

9. The play apparatus of claim 1, wherein:

a) each central line extends generally vertically of the corresponding first and second body members.

10. The play apparatus of claim 1, wherein:

a) the lengths of the torso of said first and second body members are substantially the same.

11. The play apparatus of claim 10, wherein:

a) the combined length of the head and torso of said first body member is substantially the same as the combined length of the head and torso of second body member.

12. The play apparatus of claim 1, wherein:

a) said first body member comprises a first external appearance;

b) said second body member comprises a second external appearance; and c) said third body member comprises a third external appearance.

13. The play apparatus of claim 1, wherein:

a) said first, second, third, and fourth sections include first, second, third, and fourth game values, respectively.

14. The play apparatus of claim 13, wherein:

a) said first body member includes a game value derived from said first and second game values.

15. The play apparatus of claim 14, wherein:

a) said second body member includes a game value derived from said third and fourth game values.

16. The play apparatus of claim 15, wherein:

a) said third body member includes a game value derived from the game values of said one of said first and second sections and said one of said third and fourth sections.

17. The play apparatus of claim 1, wherein:

a) said first, second, third, and fourth sections include first, second, third, and fourth names, respectively.

18. The play apparatus of claim 17, wherein:

b) said first body member includes a name derived from said first and second names.

19. The play apparatus of claim 18, wherein:

a) said second body member includes a name derived from said third and fourth names.

20. The play apparatus of claim 19, wherein:

a) said third body member includes a name derived from the names of said one of said first and second sections and said one of said third and fourth sections.

21. A play apparatus, comprising:

a) a first body member comprising a front and a rear and being separable into first and second sections;

b) a second body member comprising a front and a rear and being separable into third and fourth sections;

c) each of said first and second body members including a head and a torso;

d) each of said first and second body members being separable about a corresponding generally central line extending from the corresponding head to the bottom of the corresponding torso and from the front to the rear thereof;

e) said, first, second, third and fourth sections including first, second, third and fourth preassigned game values, respectively;

f) the lengths of said first and second body members being substantially the same;

g) said first body member comprising a first external appearance, and said second body member comprising a second external appearance different from said first external appearance; and h) one of said first and second sections being joinable with one of said third and fourth sections to form a third body member having a third external appearance.

22. The play apparatus of claim 21, wherein:

a) said first body member includes a game value derived from said first and second preassigned game values.

23. The play apparatus of claim 22, wherein:

a) said second body member includes a game value derived from said third and fourth preassigned game values.

24. The play apparatus of claim 23, wherein:

a) said third body member includes a game value derived from the game values of said one of said first and second sections and said one of said third and fourth sections.

25. The play apparatus of claim 21, wherein:

a) said first, second, third, and fourth sections include first, second, third, and fourth names, respectively.

26. The play apparatus of claim 25, wherein:

a) said first body member includes a name derived from said first and second names.

27. The play apparatus of claim 26, wherein:

a) said second body member includes a name derived from said third and fourth names.

28. The play apparatus of claim 26, wherein:

a) said third body member includes a name derived from the names of said one of said first and second sections and said one of said third and fourth sections.

29. The play apparatus of claim 21, wherein:

a) the lengths of the torso of said first and second body members are substantially the same.

30. The play apparatus of claim 29, wherein:

a) the combined length of the head and torso of said first body member is substantially the same as the combined length of the head and torso of said second body member.

31. The play apparatus of claim 30, wherein:

a) the head and torso of said first body member are integral.

32. The play apparatus of claim 21, wherein:

a) one of said first, second, third and fourth game values is variable.

33. The play apparatus of claim 21, wherein:

a) one of said first, second, third and fourth game values comprises a numerical value representing a power value for the corresponding section.

34. The play apparatus of claim 22, further comprising:

a) means for indicating the game value for said first body member.

35. The play apparatus of claim 34, wherein:

a) said game value indicating means comprises an audible or visible signal.

* * * * *